US010293500B1

(12) United States Patent
Baker

(10) Patent No.: US 10,293,500 B1
(45) Date of Patent: May 21, 2019

(54) CLIPPER ATTACHMENT

(71) Applicant: Michael Baker, Springfield, LA (US)

(72) Inventor: Michael Baker, Springfield, LA (US)

( * ) Notice: Subject to any disclaimer, the term of this patent is extended or adjusted under 35 U.S.C. 154(b) by 40 days.

(21) Appl. No.: 15/206,237

(22) Filed: Jul. 9, 2016

Related U.S. Application Data

(63) Continuation-in-part of application No. 14/011,850, filed on Aug. 28, 2013, now abandoned.

(51) Int. Cl.
*B26B 19/20* (2006.01)
*B26B 19/22* (2006.01)
*B26B 19/38* (2006.01)

(52) U.S. Cl.
CPC ..... *B26B 19/20* (2013.01); *B26B 19/22* (2013.01); *B26B 19/3813* (2013.01)

(58) Field of Classification Search
CPC ..... B26B 19/20; B26B 19/22; B26B 19/3813
See application file for complete search history.

(56) References Cited

U.S. PATENT DOCUMENTS 1,932,876 A * 10/1933 Agostini ..... B26B 21/125 132/111
1,977,933 A * 10/1934 Agostini ..... B26B 21/125 30/30
D165,306 S * 11/1951 Schaeffer ..... D28/25
2,618,060 A * 11/1952 Giorgi ..... B26B 19/20 132/148
6,079,103 A * 6/2000 Melton ..... B26B 19/20 30/43.92
6,807,736 B2 * 10/2004 Langley ..... B26B 19/20 30/123
8,136,253 B2 * 3/2012 Zoot ..... B26B 19/3813 30/195
8,539,961 B2 * 9/2013 Gaugler ..... A45D 24/10 132/126
2004/0250429 A1 * 12/2004 McCambridge ..... B26B 19/20 30/233.5

* cited by examiner

*Primary Examiner* — Kenneth E Peterson
(74) *Attorney, Agent, or Firm* — Kenneth L. Tolar

(57) ABSTRACT

An attachment for use with a conventional barber's clipper or trimmer includes a base plate having a front edge, a rear edge and a pair of opposing side edges. Extending from the front edge of the base plate is at least one central tooth disposed between and spaced from a pair of outer teeth. In at least one embodiment, the central tooth is wider than the outer tooth to create a unique hairstyle. Formed between each outer tooth and the central tooth is a channel that extends to the clipper's cutting blade. Extending from a distal end of each tooth are a pair of elongated, spaced tines that form a U-shaped slot for collecting and bundling a significant portion of hair to isolate it from the cutting blade.

5 Claims, 5 Drawing Sheets

Fig. 10
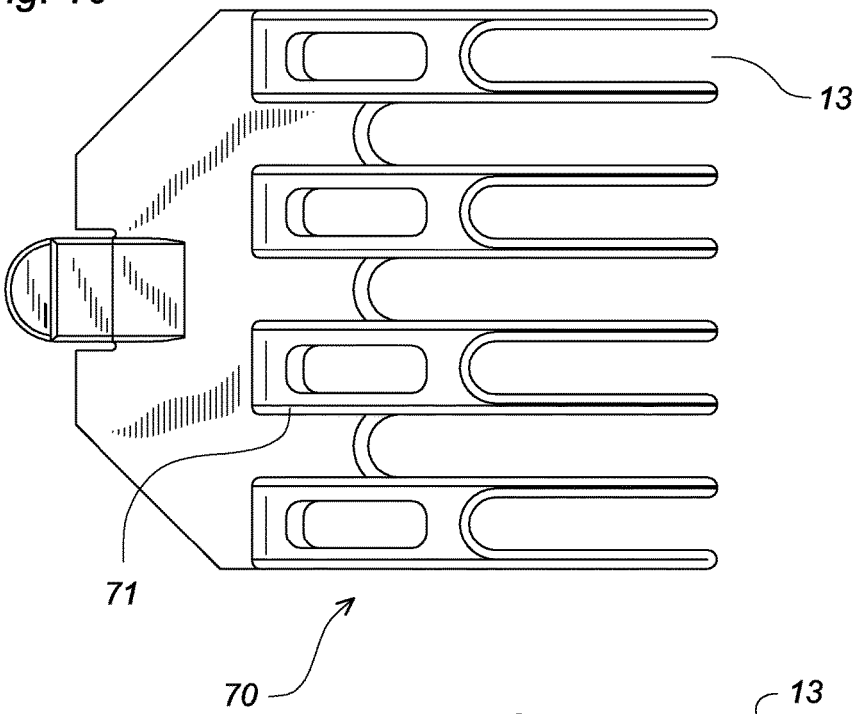
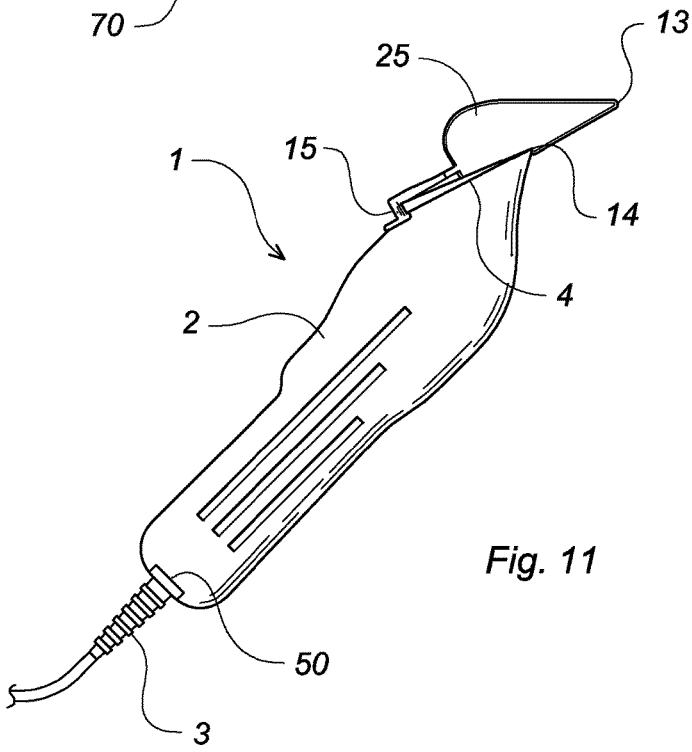
Fig. 11

CLIPPER ATTACHMENT

CROSS REFERENCE TO RELATED APPLICATIONS

This application is a continuation-in-part of application Ser. No. 14/011,850, now abandoned, the specification of which is incorporated herein by reference.

BACKGROUND OF THE INVENTION

The present invention relates to an attachment that allows a barber to quickly feather longer hair with a barber's trimmer.

DESCRIPTION OF THE PRIOR ART

Barbers often prefer the speed and convenience of a powered clipper when trimming hair. A typical powered clipper includes a handheld housing having a motorized cutting blade at an end thereof that automatically trims hair. To assure that the hair is trimmed to a desired, consistent length, a barber will sometimes fasten a clipper guard or "attachment" to the housing, near the blade. The attachment resembles a comb with equally spaced, narrow teeth that slide along the scalp as the barber maneuvers the blade through the hair. A notch or ledge on each tooth spaces the blade a predetermined distance from the scalp to trim the hair to a uniform, desired length. Most barbers use numerous, interchangeable attachments that each space the blade a discrete distance from the scalp so that the resulting, uniform length can be varied according to a customer's request.

Because conventional clipper attachments are specifically designed to trim hair to a uniform length, they are useless for creating more elaborate hairstyles, such as feathered or tapered cuts, without significant training and effort. Therefore, a barber will often use conventional scissors for more complex hairstyles, which is laborious and time consuming.

Accordingly, there is currently a need for a clipper attachment that allows a barber to create a unique, feathered hairstyle using a barber's clipper. A review of the prior art reveals at least three clipper attachments that are designed to create a feathered cut. For example, U.S. Pat. No. 8,136,253 issued to Zoot discloses a clipper attachment having multiple, equally sized slots for receiving hair to allow access to a cutting blade. Interposed tines block a remainder of hair contacting the attachment from the cutting blade to purportedly create various textures or styles.

U.S. Pat. No. 2,229,688 issued to Waldron discloses a feathering attachment for clippers having a movable bottom plate that varies a distance between the scalp and a cutting blade to produce a feathered cut.

U.S. Pat. No. 3,149,418 issued to Milbourne discloses an adjustable clipper attachment that allows a barber to vary the relative spacing of a cutting blade. The attachment includes vertically spaced notches on an inner surface for receiving the cutting blade. Accordingly, a user can position the cutting blade within any one of the notches to adjust the distance between the blade and scalp.

U.S. Pat. No. 4,867,184 issued to Davis discloses an arcuate comb for use with electric clippers to create various hair designs.

U.S. Pat. No. 5,107,591 issued to Salo discloses thinning scissors.

European patent publication no. EP0925885 to Wahl discloses an attachment comb for hair clippers having teeth with arcuate lower surfaces that glide more comfortably on the scalp, and which are proportioned to trim the hair to a length of no less than one inch.

European patent publication no. EP 2085194 to Braun discloses a comb for a hair trimmer having wider guard teeth and interposed narrower teeth. The unique geometry of the teeth minimizes injuries to the scalp and increases cutting efficiency.

U.S. Pat. No. D286,454 issued to Stephens discloses an ornamental design for a hair-trimmer attachment.

Although the patents to Waldron and Milbourne disclose a clipper attachment for purportedly creating feathered haircuts, they each require frequent, manual adjustment or manipulation of a component in order to create the desired hairstyle, which is tedious and laborious. Furthermore, because the devices are formed of several movable parts, they are difficult and expensive to manufacture.

Zoot uses spaced teeth or tines with slots therebetween to isolate a portion of hair from a cutting blade. The device of Zoot is designed to isolate and cut an equal amount of hair, i.e., the leading edge of each tooth has the approximately same width as each interposed slot. Furthermore, the teeth each include a pair of extremely short fins extending therefrom that primarily prevent excess hair from entering the slots when the slots are full of hair to be cut. The device of Zoot is designed to create unique or grooved patterns in shorter hairstyles, and cannot penetrate or properly isolate longer hair according to the present invention.

The present invention overcomes the disadvantages of the prior art by providing a clipper or trimmer attachment having a plurality of teeth with channels formed therebetween. Extending from each tooth are a pair of elongated, spaced tines that form a U-shaped slot for preventing a substantial portion of longer hair from entering the channels and contacting the cutting blade. Accordingly, only the hair that actually enters the channels will be trimmed thereby allowing a barber to effortlessly create a unique, feathered hairstyle with a conventional barber's clipper or trimmer.

SUMMARY OF THE INVENTION

An attachment for use with a conventional barber's clipper includes a base plate having a front edge, a rear edge and a pair of opposing side edges. Extending from the front edge of the base plate is at least one central tooth disposed between and spaced from a pair of outer teeth. In at least one embodiment, the central tooth is wider than the outer tooth to create a unique hairstyle. Formed between each outer tooth and the central tooth is a channel that extends to the clipper's cutting blade. Extending from a distal end of each tooth are a pair of elongated, spaced tines that form a U-shaped slot for collecting and bundling a significant portion of hair to isolate it from the cutting blade.

As the attachment is slid through hair, the slots isolate a significant portion of the hair from the cutting blade. Therefore, a barber can effortlessly create an elaborate, feathered or tapered hairstyle using a powered clipper or trimmer by simply sliding the attachment through a person's hair.

It is therefore an object of the present invention to provide a clipper attachment that allows a barber to quickly and easily create a unique, feathered hairstyle.

It is another object of the present invention to provide a clipper attachment having teeth with elongated slots formed thereon for isolating a significant portion of longer hair from a cutting blade.

Other objects, features, and advantages of the present invention will become readily apparent from the following detailed description of the preferred embodiment when considered with the attached drawings and the appended claims.

BRIEF DESCRIPTION OF THE DRAWINGS

FIG. 10 is a top, plan view of a third embodiment.

FIG. 11 depicts the attachment according to any of the embodiments described herein fastened to a barber's clipper or trimmer.

DESCRIPTION OF THE PREFERRED EMBODIMENT

Figure 1:
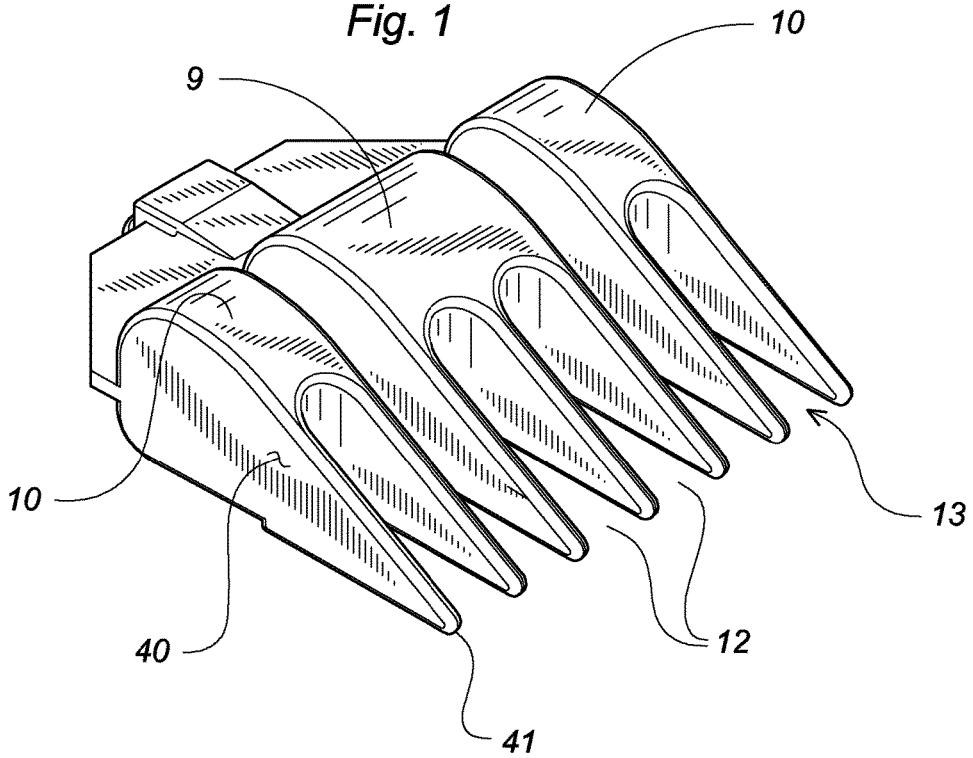
FIG. 1 is a top, perspective view of the attachment according to the present invention.
Figure 2:
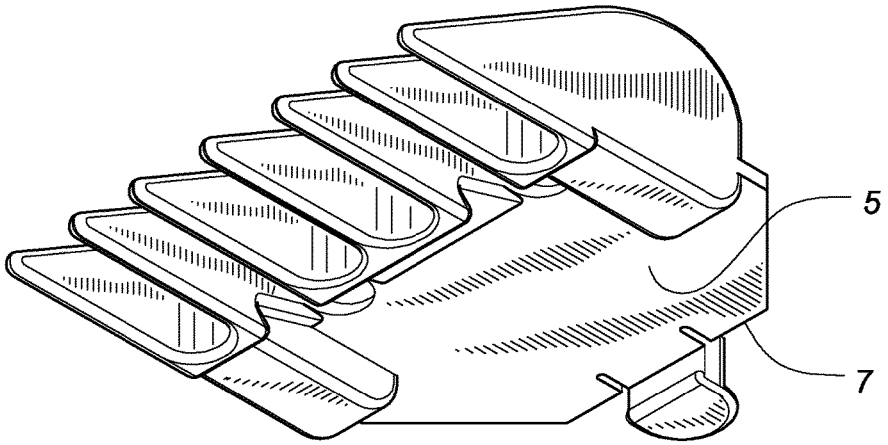
FIG. 2 is a bottom, perspective view of the attachment according to the present invention.
Figure 3:
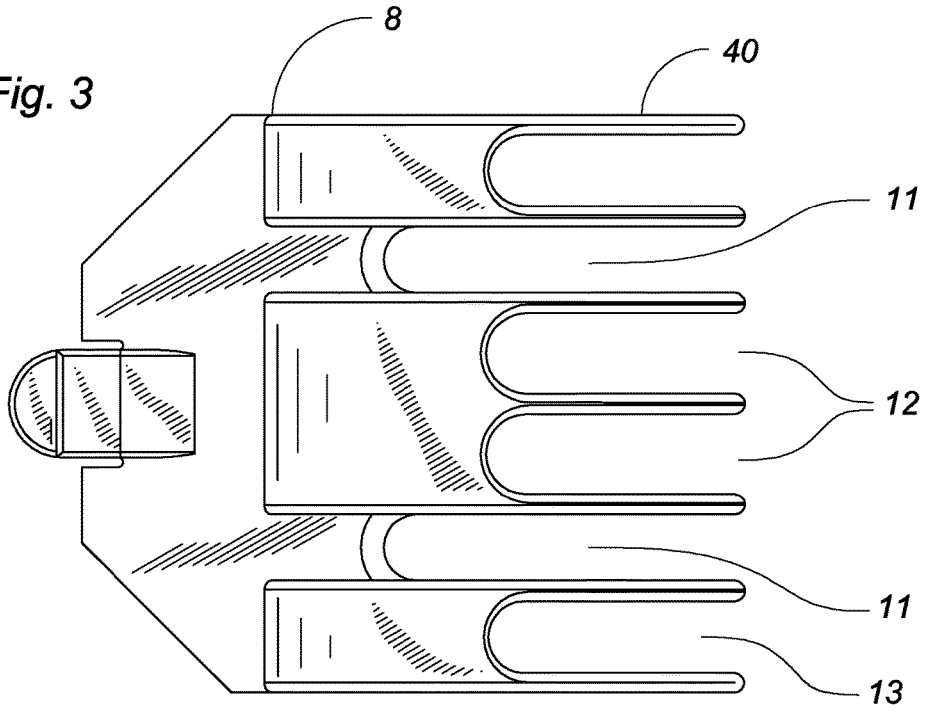
FIG. 3 is a top, plan view of the attachment.
Figure 4:
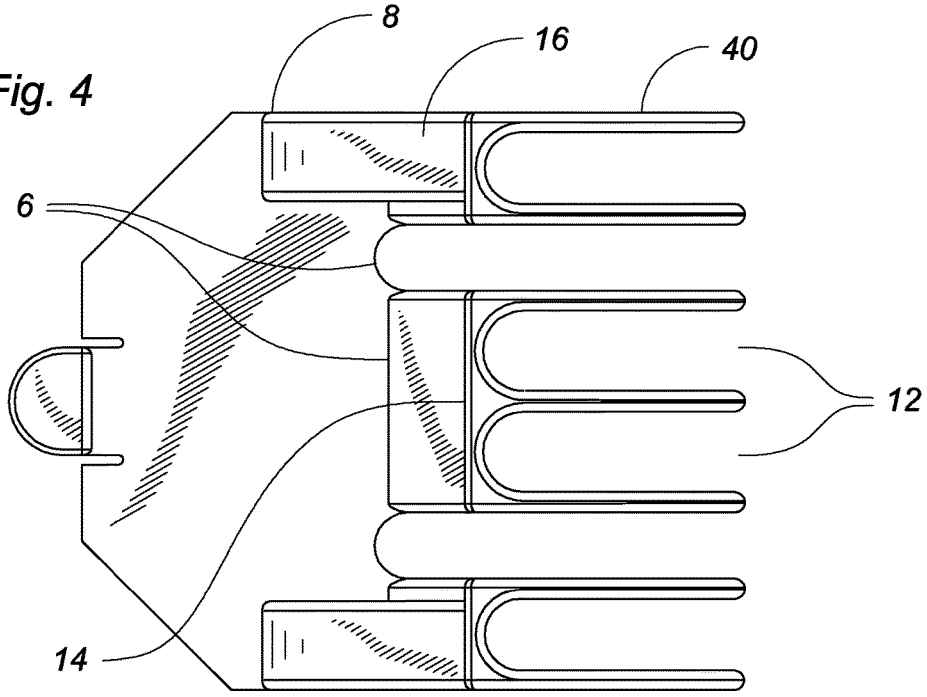
FIG. 4 is a bottom, plan view of the attachment
Figure 5:
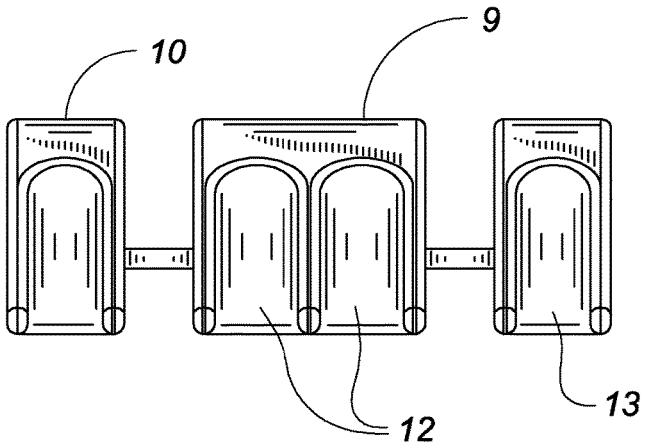
FIG. 5 is a front view of the attachment.
Figure 6:
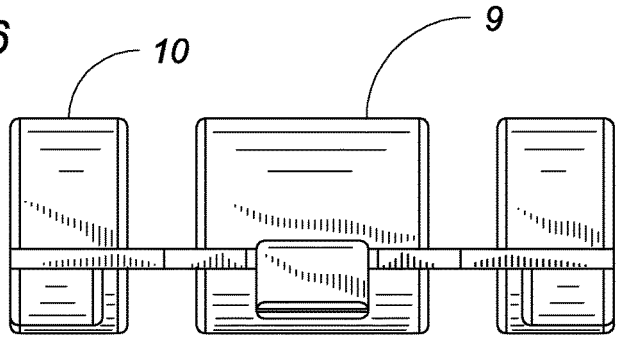
FIG. 6 is a rear view of the attachment.
Figure 7:
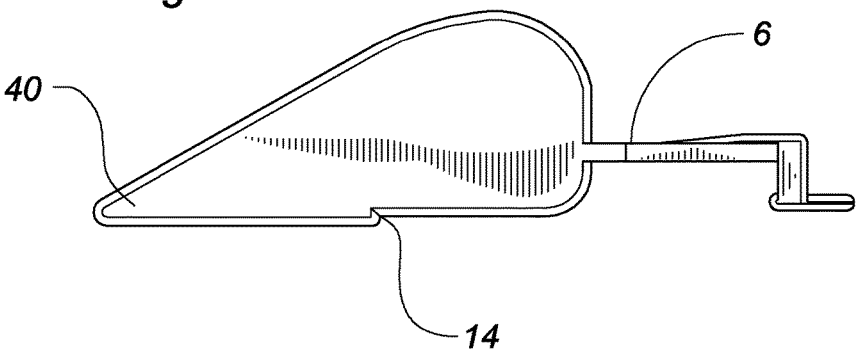
FIG. 7 is a side view of the attachment.

The present invention relates to a clipper attachment for a conventional, electrically powered barber's trimmer 1 that includes, inter alia, an elongated, handheld housing 2 having a power cord receptacle 50 at a lower end and a motorized cutting blade 4 at the upper end. A power cord 3 is coupled with both a power source and the receptacle 50 to automatically recharge an internal battery that actuates the blade in a conventional fashion.

The attachment 25 according to the present invention, identified generally as 25 in FIG. 11, is designed for use with a conventional trimmer of the type described above. Now referring specifically to FIGS. 1-8, a first embodiment includes a base plate 5 having a front edge 6, a rear edge 7 and a pair of opposing side edges 8. Extending from the front edge of the base plate is a central, wide tooth 9 disposed between and spaced from a pair of outer, narrower teeth 10. Formed between each outer tooth and the central tooth (and the tines 40 extending therefrom described, infra) is a U-shaped channel 11 that extends to the front edge of the base plate. The width of both the central tooth and the outer teeth is greater than that of the channels to block or isolate more hair than that being trimmed.

A distal end of the central tooth includes a pair of juxtaposed, segregated, U-shaped slots 12 that collect and bundle hair strands to prevent them from entering the channels. Each outer tooth 10 includes a single, similar slot 13 at a distal end that further isolates additional hair strands from the channels.

The slots 12, 13 are each formed of a pair of elongated, spaced tines 40, each having a substantially triangular configuration and terminating at an apex 41 for easily penetrating longer hair. Preferably, the length of each tine 40 is substantially equal to or greater than that of each tooth 9, 10, and that of each channel 11 to form a long trough for isolating longer hair from the cutting blade while adjacent, longer hair enters the channels to engage the cutting blade 4. Furthermore, each slot is wider than each interposed channel so that more hair is bundled in the slots and isolated from the blade relative to that being trimmed in the channels.

The wider central tooth 9 allows the formation of a wider slot having a greater holding capacity than the slots on the narrower, outer teeth to create a unique hairstyle as described herein. Furthermore, by using three tines on the central tooth to form two segregated slots having a combined width that far exceeds that of the outer slots (and each channel), as opposed to a creating a single wide slot, allows the attachment to more easily glide through longer hair.

The lower surface of each tooth includes a ledge 14 proximal the lower end of the U-shaped slots that fixes the cutting edge of the blade at a predetermined distance within each channel to trim hair entering the channels to a desired length. Furthermore, the base plate and a shoulder 16 on each of two opposing sides thereof form a receptacle for receiving the trimmer blade when the attachment is properly secured to the trimmer housing. The base plate is positioned on a plane that approaches that of the lower surfaces of the teeth and tines to elevate the trimmer blade above the scalp when the upper surface of the attachment is properly resting thereon to further maintain a longer hairstyle. On the rear edge of the base plate is a latch 15 or a similar means for fastening the attachment to the upper end of the housing in a conventional fashion.

Figure 8:
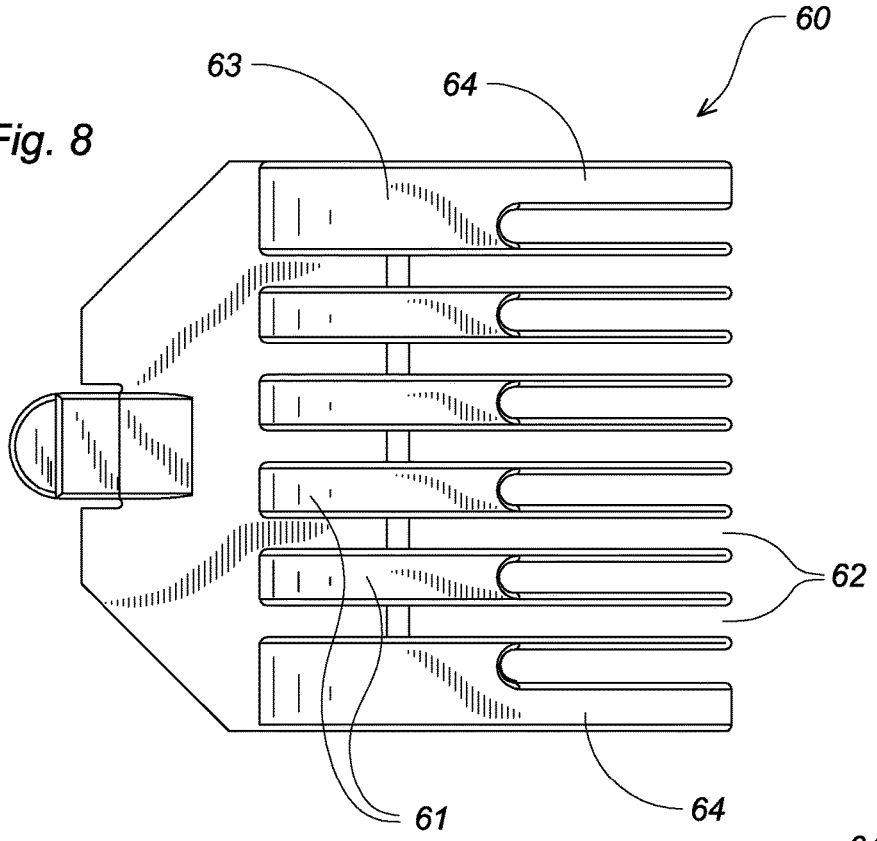
FIG. 8 is a top, plan view of a slightly different embodiment of the attachment according to the present invention.
Figure 9:
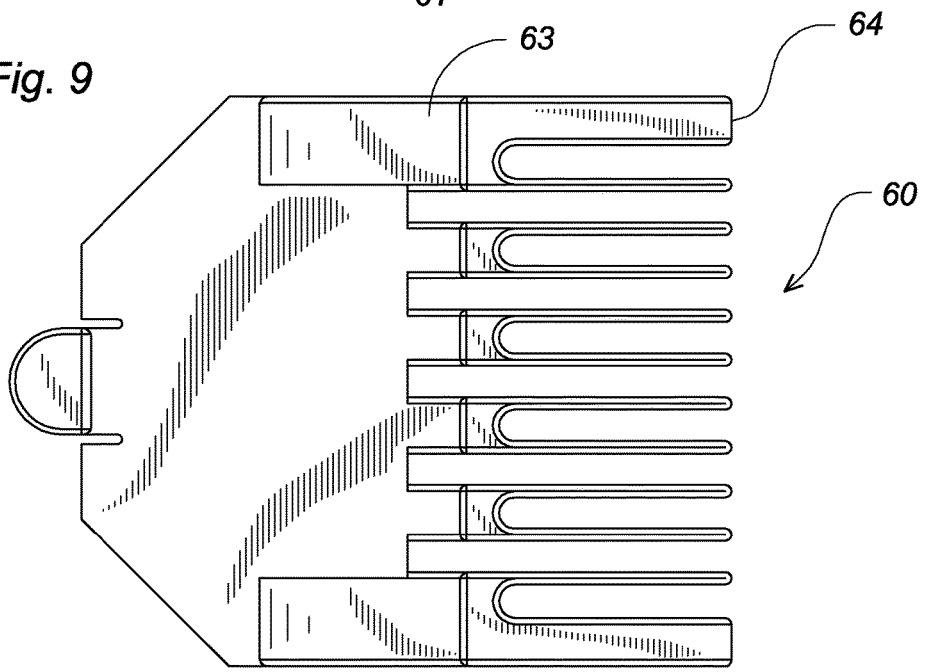
FIG. 9 is a bottom view of the attachment of FIG. 8.

Now referring to FIGS. 8 and 9, a second embodiment 60 includes a plurality of narrower, central teeth 61 and two wider, outer teeth 63 with channels 62 therebetween. Each outer tooth 63 includes a wider outer tine 64 for funneling more hair toward an adjacent slot. Finally, referring to FIG. 10, a third embodiment 70 includes a plurality of teeth 71 each having the same width for creating a different feathered style than the embodiments having wide and narrow teeth. As with the first embodiment, the embodiments depicted in FIGS. 8-10 include tines that are approximately the same length as each tooth and at least half the length of each channel to isolate and collect longer hair. Furthermore, each embodiment includes teeth and slots that are wider than the interposed channels to isolate more hair than is being cut.

Accordingly, when the attachment is secured to the clipper or trimmer in a conventional fashion, the cutting blade extends a predetermined distance into each channel according to a desired hair length. As the attachment glides through hair, the width of the teeth and the length of the juxtaposed slots isolate a significant portion of longer hair strands from the cutting blade. Therefore, a barber can effortlessly create a unique, feathered or tapered hairstyle with a powered trimmer by simply sliding the attachment through a person's hair.

The above-described device is not limited to the exact details of construction and enumeration of parts provided herein. For example, the number and size of teeth could be varied to create a desired hairstyle. Though the attachment can be configured for use with virtually any type of powered clipper, it is preferably configured to attach to a handheld trimmer of the type typically used for trimming sideburns, the neck or eyebrows. The teeth and corresponding slots are preferably dimensioned to isolate 60-70% of the hair from the cutting blade though the percentage could be varied somewhat, if desired. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. In combination with a handheld trimmer having a housing with a motorized cutting blade at an end thereof, an attachment comprising:

a base plate having a front edge, a rear edge and a pair of opposing side edges;

means for attaching said base plate to the end of said housing, proximal said cutting blade;

a plurality of teeth extending from the front edge of said base plate, wherein said plurality of teeth include a single central tooth disposed between and spaced from a pair of outer teeth, said central tooth wider than said outer teeth to isolate a greater portion of hair than said outer teeth to create a unique hairstyle;

a channel formed between each of said outer teeth and said central tooth, said channel extending to said cutting blade;

at least one elongated slot on a distal end of each of said outer teeth, the slot on each of said outer teeth formed of a pair of spaced, elongated tines extending from a distal end of each of said outer teeth, said tines having a length that is at least half of a length of said channel to form a long trough for isolating long hair strands from the cutting blade while adjacent long hair strands enter the channels and engage said cutting blade;

a first slot and a second slot on a distal end of said central tooth, wherein the first slot and the second slot are formed of three, spaced, elongated tines extending from a distal end of said central tooth, said three, spaced elongated tines having a length that is greater than half of a length of said channel to form long troughs for isolating long hair strands from the cutting blade while adjacent long hair strands enter the channels and engage said cutting blade, said elongated slot, said first slot and said second slot wider than said channel and having a combined width that is greater than a width of the slot on either of said outer teeth for capturing a greater portion of a person's hair than said channel as the attachment is moved along a scalp to prevent the greater portion of a person's hair from entering said channel and engaging said cutting blade thereby creating a unique feathered hairstyle.

2. The combination according to claim 1 wherein said outer teeth, said central tooth, the slot on each of said outer teeth and the slot on said central tooth are dimensioned to isolate 60-70% of hair engaged by said attachment from the cutting blade as the attachment is moved along a scalp.

3. The combination according to claim 1 wherein each of said outer teeth and said central tooth includes a ledge proximal a lower end that fixes the cutting blade at a predetermined distance within each channel to trim hair entering the channels to a desired length.

4. The combination according to claim 1 further comprising a shoulder on each of two sides of said base plate, said shoulder, said ledge and said base plate forming a receptacle for receiving said cutting blade.

5. The combination according to claim 1 wherein the base plate is positioned on a plane that approaches a plane of lower surfaces of said teeth and lower surfaces of said tines to elevate the cutting blade above the scalp when an upper surface of the attachment is resting thereon to further maintain a longer hairstyle.

* * * * *